US012127673B2

(12) United States Patent
Chen et al.

(10) Patent No.: US 12,127,673 B2
(45) Date of Patent: Oct. 29, 2024

(54) SLIDE RAIL ASSEMBLY AND SLIDE RAIL KIT

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Tzu-Cheng Weng, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 164 days.

(21) Appl. No.: 18/083,590

(22) Filed: Dec. 19, 2022

(65) Prior Publication Data

US 2024/0065438 A1 Feb. 29, 2024

(30) Foreign Application Priority Data

Aug. 24, 2022 (TW) ..... 111132228

(51) Int. Cl.
*A47B 88/57* (2017.01)
*A47B 88/477* (2017.01)
*A47B 88/483* (2017.01)

(52) U.S. Cl.
CPC ..... *A47B 88/57* (2017.01); *A47B 88/477* (2017.01); *A47B 88/483* (2017.01); *A47B 2210/0018* (2013.01)

(58) Field of Classification Search
CPC ..... A47B 88/57; A47B 88/477; A47B 88/483; A47B 2210/0018
(Continued)

(56) References Cited

U.S. PATENT DOCUMENTS 5,248,195 A * 9/1993 Shin ..... A47B 88/402 312/334.33
6,935,710 B2 * 8/2005 Chen ..... A47B 88/487 312/334.44
(Continued)

FOREIGN PATENT DOCUMENTS

CN 112237345 A * 1/2021 ..... A47B 88/44
EP 3488733 A1 * 5/2019 ..... A47B 88/40
(Continued)

*Primary Examiner* — Janet M Wilkens
(74) *Attorney, Agent, or Firm* — Winston Hsu

(57) ABSTRACT

A slide rail assembly is provided and includes a first rail, a second rail movable with respect to the first rail, a working member, an operating member and a blocking member. When the second rail is located at an extended position with respect to the first rail and the working member is in a first state, the working member and a blocking feature of the first rail block each other for restraining the second rail from moving toward a first predetermined direction from the extended position. The blocking member is switchable between a blocking state and a non-blocking state for restraining the operating member from driving the working member to disengage from the first state or for allowing the operating member to drive the working member from the first state to a second state. Besides, a related slide rail kit is also provided.

9 Claims, 13 Drawing Sheets

(58) Field of Classification Search
USPC ..... 312/334.1, 333, 334.44–334.47
See application file for complete search history.

(56) References Cited

U.S. PATENT DOCUMENTS

| | | | | |
|---|---|---|---|---|
| 6,945,619 | B1 * | 9/2005 | Chen | A47B 88/487 312/334.47 |
| 7,658,457 | B2 | 2/2010 | Lu | |
| 10,743,658 | B1 * | 8/2020 | Chen | A47B 88/447 |
| 10,973,322 | B1 * | 4/2021 | Chen | A47B 88/493 |
| 2018/0070723 | A1 | 3/2018 | Chen | |
| 2018/0270982 | A1 | 9/2018 | Chen | |
| 2019/0200756 | A1 * | 7/2019 | Chen | A47B 88/473 |
| 2019/0335903 | A1 * | 11/2019 | Chen | A47B 88/427 |
| 2020/0214444 | A1 * | 7/2020 | Chen | A47B 88/473 |
| 2022/0061528 | A1 * | 3/2022 | Chen | A47B 88/49 |
| 2022/0065292 | A1 * | 3/2022 | Chen | A47B 88/44 |

FOREIGN PATENT DOCUMENTS

| | | | | |
|---|---|---|---|---|
| EP | 3808215 | A1 * | 4/2021 | A47B 57/402 |
| GB | 2453736 | A * | 4/2009 | A47B 88/40 |
| JP | 2018-175843 | A | 11/2018 | |
| TW | 1584761 | * | 6/2017 | |

* cited by examiner

SLIDE RAIL ASSEMBLY AND SLIDE RAIL KIT

BACKGROUND OF THE INVENTION

1. Field of the Invention

The present invention relates to a slide rail product, and more specifically, to a slide rail assembly with enhanced using safety and a related slide rail kit.

2. Description of the Prior Art

U.S. Pat. No. 6,935,710 B2 discloses a two-way retainer for a slide track assembly including a first slide track and a second slide track. The two-way retainer includes a retaining mechanism and a stop member respectively disposed on the first slide track and the second slide track. The retaining mechanism includes at least two retaining arms, and the stop member includes a blocking portion. When the first slide track is located at a predetermined operating position, such as an extended position, with respect to the second slide track, the blocking portion of the stop member disposed on the second slide track is located between and engaged by the two retaining arms for bi-directionally positioning the first slide track with respect to the second slide track. Furthermore, the two retaining arms can be operated by at least one linkage to pivotally disengage from the blocking portion of the stop member to allow the first slide track to move with respect to the second slide track from the predetermined operating position toward a retracting direction for retracting the first slide track into the second slide track, or toward an opening direction for detaching the first slide track from the second slide track.

However, when the at least one linkage is accidentally touched, an unintentional movement of the first slide track with respect to the second slide track may cause device damage or personal injury. Therefore, it becomes an important topic to provide to a slide rail product with enhanced using safety.

SUMMARY OF THE INVENTION

It is an objective of the present invention to provide to a slide rail assembly with enhanced using safety and a related slide rail kit.

According to an aspect of the present invention, a slide rail assembly includes a first rail, a second rail, a working member, an operating member and a blocking member. The first rail includes a blocking feature. The second rail is movable with respect to the first rail. The working member is arranged on the second rail. The operating member is configured to operate the working member. The blocking member is arranged on the second rail. When the second rail is located at a predetermined position with respect to the first rail and the working member is in a first state, the working member and the blocking feature block each other for restraining the second rail from moving toward a predetermined direction from the predetermined position. When the blocking member is in a blocking state, the blocking member blocks the operating member for restraining the operating member from driving the working member to disengage from the first state. When the blocking member is in a non-blocking state, the blocking member does not block the operating member for allowing the operating member to drive the working member from the first state to a second state, and when the working member is in the second state, the working member and the blocking feature do not block each other for allowing the second rail to move toward the predetermined direction from the predetermined position.

Preferably, the first rail includes a first wall, a second wall and a longitudinal wall. The longitudinal wall of the first rail is connected between the first wall and the second wall of the first rail. The first wall, the second wall and the longitudinal wall of the first rail cooperatively define a channel for accommodating the second rail. When the blocking member is in the non-blocking state, the blocking member does not block the operating member for allowing the operating member to drive the working member from the first state to the second state, and when the working member is in the second state, the working member and the blocking feature do not block each other for allowing the second rail to be detached from the channel by moving the second rail toward the predetermined direction from the predetermined position.

Preferably, the operating member is movably mounted on the second rail.

Preferably, the working member is pivotally connected to the second rail.

Preferably, the slide rail assembly further includes a resilient member configured to provide a resilient force to the working member for resiliently retaining the working member in the first state.

Preferably, the first rail includes a front portion and a rear portion, and the blocking feature is located adjacent to the front portion of the first rail.

According to another aspect of the present invention, a slide rail assembly includes a first rail, a second rail, a first working member, a first operating member and a blocking member. The first rail includes a blocking feature. The second rail is movable with respect to the first rail. The first working member is arranged on the second rail. The first operating member is configured to operate the first working member. The blocking member is arranged on the second rail and being resiliently recoverable. When the second rail is located at an extended position with respect to the first rail and the first working member is in a first state, the first working member and the blocking feature block each other for restraining the second rail from moving toward a first predetermined direction from the extended position. When the blocking member is in a blocking state, the blocking member blocks the first operating member for restraining the first operating member from driving the first working member to disengage from the first state. When the blocking member is forced to switch from the blocking state to a non-blocking state, the blocking member does not block the first operating member for allowing the first operating member to drive the first working member from the first state to a second state. When the first working member is in the second state, the first working member and the blocking feature do not block each other for allowing the second rail to move toward the first predetermined position from the extended position. When the blocking member in the non-blocking state is released, the blocking member resiliently recovers to switch from the non-blocking state to the blocking state.

Preferably, the first predetermined direction is an opening direction.

Preferably, the first rail comprises a first wall, a second wall and a longitudinal wall. The longitudinal wall of the first rail is connected between the first wall and the second wall of the first rail. The first wall, the second wall and the longitudinal wall of the first rail cooperatively define a channel for accommodating the second rail. When the blocking member is in the non-blocking state, the blocking member does not block the first operating member for allowing the first operating member to drive the first working member from the first state to the second state. When the first working member is in the second state, the first working member and the blocking feature do not block each other for allowing the second rail to be detached from the channel by moving the second rail toward the first predetermined direction from the extended position.

Preferably, the first operating member is movably mounted on the second rail.

Preferably, the first operating member is pivotally connected to the second rail.

Preferably, the slide rail assembly further includes a resilient member configured to provide a resilient force to the first working member for resiliently retaining the first working member in the first state.

Preferably, the first rail includes a front portion and a rear portion, and the blocking feature is located adjacent to the front portion of the first rail.

Preferably, the slide rail assembly further includes a second working member and a second operating member. The second working member is arranged on the second rail. The second operating member is configured to operate the second working member. When the second rail is located at the extended position with respect to the first rail and the second working member is in a third state, the second working member and the blocking feature blocking each other for restraining the second rail from moving toward a second predetermined direction from the extended position.

Preferably, when the second operating member drives the second working member from the third state to a fourth state, the second working member and the blocking feature do not block each other for allowing the second rail to move toward the second predetermined direction from the extended position.

Preferably, the second predetermined direction is a retracting direction.

According to another aspect of the present invention, a slide rail kit includes a slide rail, a working member, an operating member and a blocking member. The working member is arranged on the slide rail. The operating member is configured to operate the working member. The blocking member is arranged on the slide rail. When the blocking member is in a blocking state, the blocking member blocks the operating member for restraining the operating member from driving the working member. When the blocking member is in a non-blocking state, the blocking member does not block the operating member for allowing the operating member to drive the working member from a first state to a second state.

Preferably, the operating member is movably mounted on the slide rail.

Preferably, the working member is pivotally connected to the slide rail.

Preferably, the slide rail kit further includes a resilient member configured to provide a resilient force to the working member.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The members of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
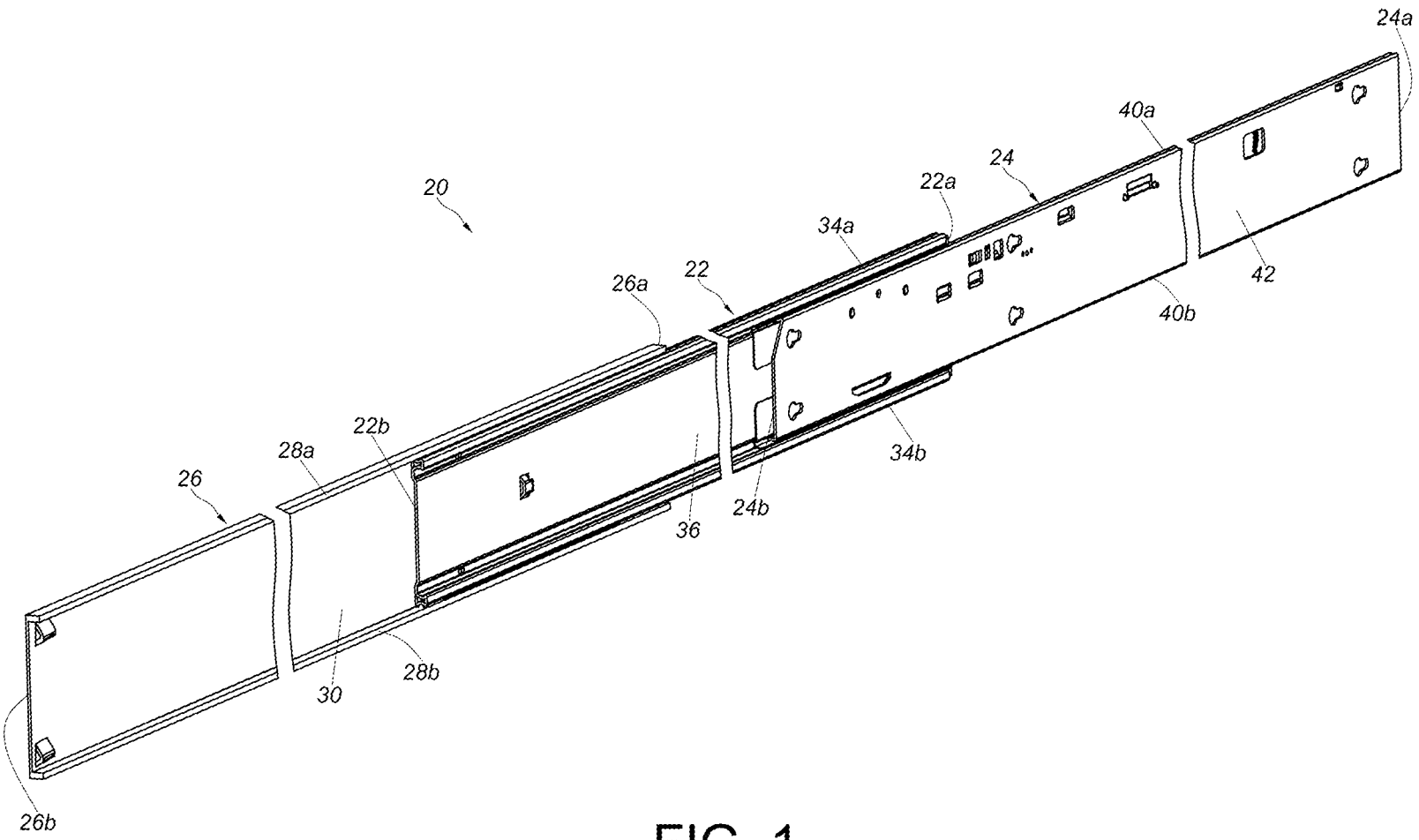
FIG. 1 is a perspective diagram of a slide rail assembly in an extended state according to a first embodiment of the present invention.
Figure 2:
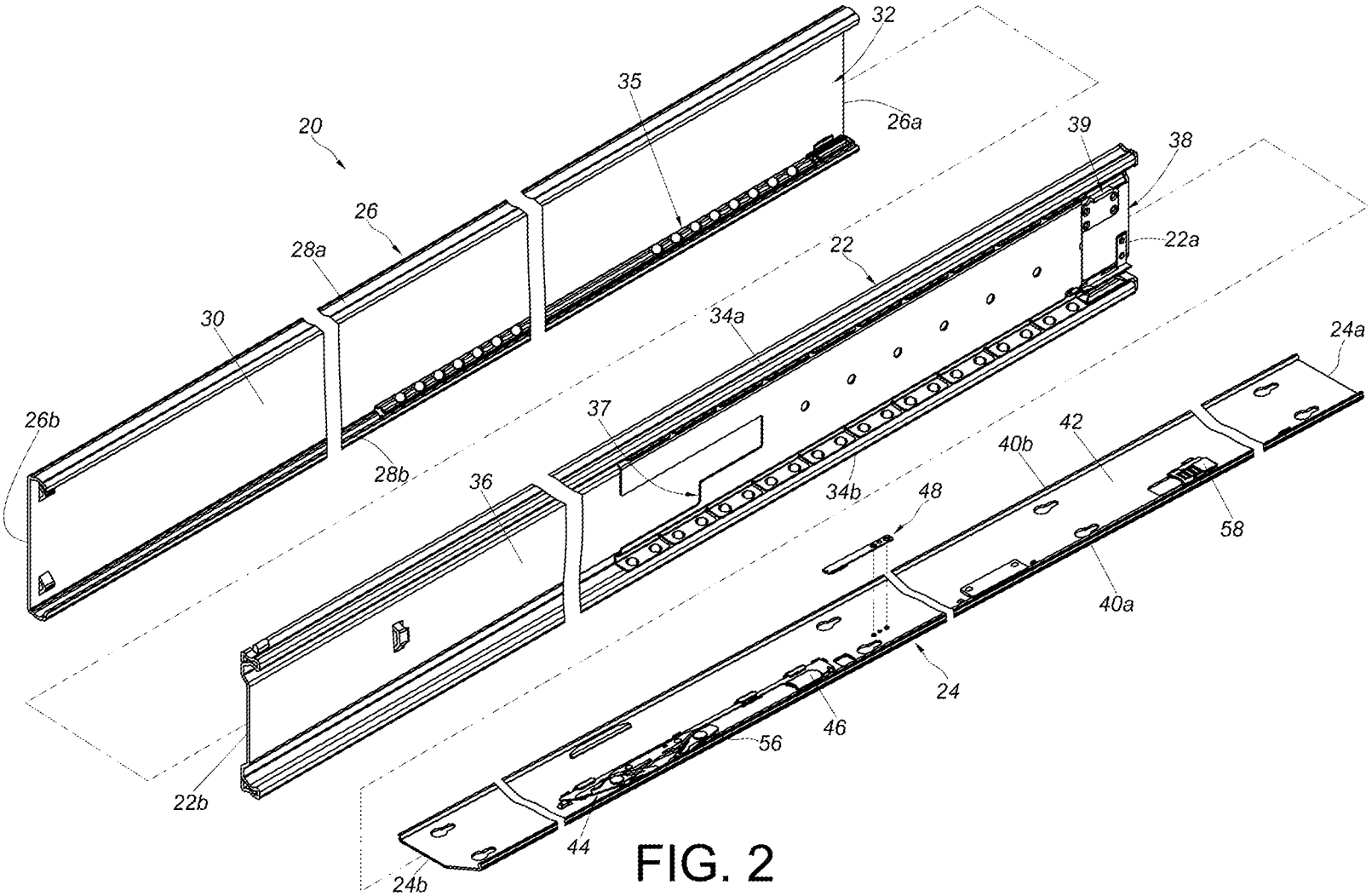
FIG. 2 is an exploded diagram of the slide rail assembly according to the first embodiment of the present invention.

Please refer to FIG. 1 and FIG. 2. As shown in FIG. 1 and FIG. 2, in a first embodiment of the present invention, a slide rail assembly 20 includes a first rail 22 and a second rail 24. Preferably, the slide rail assembly 20 further includes a third rail 26. The first rail 22 is movably mounted between the third rail 26 and the second rail 24 and configured to extend a travelling distance of the second rail 24 with respect to the third rail 26. In this embodiment, the third rail 26, the first rail 22 and the second rail 24 can respectively be an outer rail, a middle rail longitudinally movable with respect to the outer rail and an inner rail longitudinally movable with respect to the middle rail, i.e., the slide rail assembly 20 can be a three-segment type slide rail assembly. However, the present invention is not limited to this embodiment. For example, in another embodiment, the slide rail assembly can include the first rail and the second rail only, and the first rail and the second rail can respectively be the outer rail and the inner rail longitudinally movable with respect to the outer rail, i.e., the slide rail assembly can be a two-segment type slide rail assembly.

The third rail 26 includes a first wall 28*a*, a second wall 28*b* and a longitudinal wall 30 connected between the first wall 28*a* and the second wall 28*b* of the third rail 26. The first wall 28*a*, the second wall 28*b* and the third wall 30 of the third rail 26 cooperatively define a channel 32 of the third rail 26 for at least partially accommodating the first rail 22. The third rail 26 includes a front portion 26*a* and a rear portion 26.

The first rail 22 includes a first wall 34*a*, a second wall 34*b* and a longitudinal wall 36 connected between the first wall 34*a* and the second wall 34*b* of the first rail 22. The first wall 34*a*, the second wall 34*b* and the longitudinal wall 36 of the first rail 22 cooperatively define a channel 38 of the first rail 22 for at least partially accommodating the second rail 24. The first rail 22 includes a front portion 22*a* and a rear portion 22*b*. Besides, the first rail 22 further includes a blocking feature 39 located inside the channel 38 of the first rail 22. Preferably, in this embodiment, the blocking feature 39 can be a protruding portion laterally or transversally protruding from the longitudinal wall 36 of the first rail 22 and located adjacent to the front portion 22*a* of the first rail 22. However, the present invention is not limited to this embodiment.

The second rail 24 includes a first wall 40*a*, a second wall 40*b* and a longitudinal wall 42 connected between the first wall 40*a* and the second wall 40*b* of the second rail 24. The second rail 24 includes a front portion 24*a* and a rear portion 24*b*.

Preferably, at least one first slide facilitation device 35 is arranged inside the channel 32 of the third rail 26. The first slide facilitation device 35 includes a plurality of balls for facilitating the first rail 22 to slide with respect to the third rail 26 smoothly. On the other hand, at least one second slide facilitation device 37 is arranged inside the channel 38 of the first rail 22. The second slide facilitation device 37 includes a plurality of balls for facilitating the second rail 24 to slide with respect to the first rail 22 smoothly. However, present invention is not limited to this embodiment. For example, in another embodiment, the first slide facilitation device and/or the second slide facilitation device can be omitted.

Figure 3:
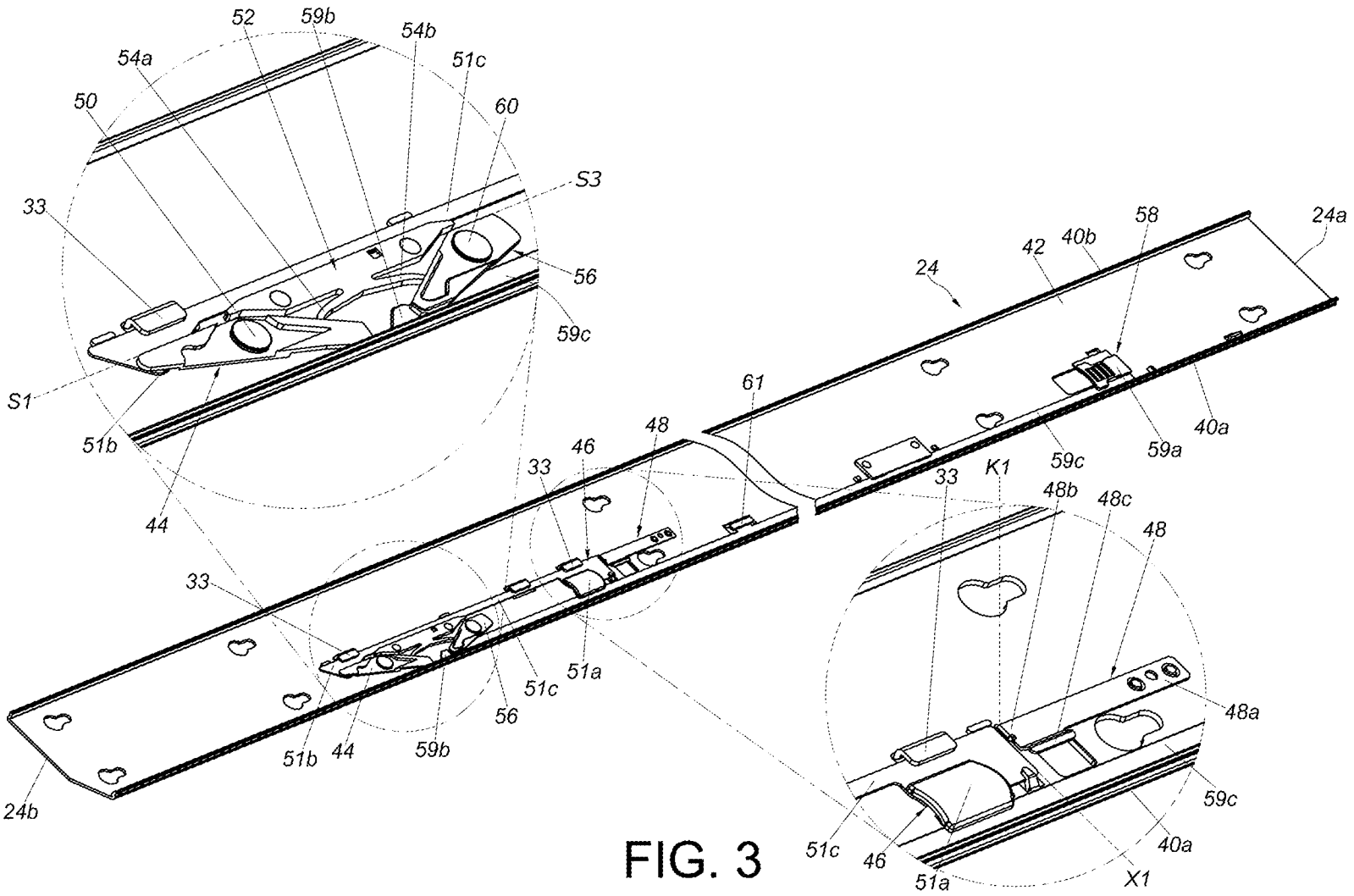
FIG. 3 is a perspective diagram of the slide rail assembly as a blocking member blocks an operating member according to the first embodiment of the present invention.

Please refer to FIG. 3. As shown in FIG. 3, the slide rail assembly 20 further includes a first working member 44, which also can be named as a working member, a first operating member 46, which also can be named as an operating member, and a blocking member 48 arranged on the second rail 24, which also can be named as a slide rail. The second rail 24, the first working member 44 and the first operating member 46 and the blocking member 48 can cooperatively form a slide rail kit. The first operating member 46 is configured to operate the first working member 44. The blocking member 48 is configured to cooperate with the first operating member 46. In this embodiment, the blocking member 48 is a resilient structure which is resiliently recoverable. In this embodiment, the blocking member 48 can be a resilient plate. However, the present invention is not limited to this embodiment. Furthermore, the blocking member 48 includes a connecting segment 48*a* and a blocking segment 48*b*. The connecting segment 48*a* is connected, e.g., fixedly connected, to the second rail 24, and the blocking segment 48*b* extends from the connecting segment 48*a*. Preferably, in this embodiment, the blocking member 48 further includes an operating segment 48*c* connected to the blocking segment 48*b*. The operating segment 48*c* is configured to allow a user to operate the blocking segment 48*b* to resiliently move with respect to the connecting segment 48*a* easily. However, present invention is not limited to this embodiment. For example, in another embodiment, the operating segment can be omitted.

Preferably, the first working member 44 is pivotally connected to the second rail 24 through a first pivoting shaft 50.

Preferably, the first operating member 46 is movably mounted on the second rail 24. In this embodiment, the first operating member 46 can be moved with respect to the second rail 24 along a longitudinal direction of the second rail 24, and the second rail 24 can include at least one first retaining feature 33 configured to support the first operating member 46 for enhancing moving stability of the first operating member 46 when the first operating member 46 is operated to move. However, the present invention is not limited to this embodiment. For example, in another embodiment, the first operating member can be pivoted with respect to the second rail without any support provided by the first retaining feature.

Preferably, the first operating member 46 includes a first operating portion 51*a*, a first driving portion 51*b* and a first extending portion 51*c* connected between the first operating portion 51*a* and the first driving portion 51*b*.

Preferably, the slide rail assembly 20 further includes a resilient member 52 arranged on the second rail 24 and configured to resiliently force the first working member 44 for resiliently retaining the first working member 44 in a first state S1. In this embodiment, the resilient member 52 can include a first resilient portion 54*a* configured to provide a first resilient force to the first working member 44. However, the present invention is not limited to this embodiment.

Preferably, the slide rail assembly 20 further includes a second working member 56 and a second operating member 58 arranged on the second rail 24 and configured to operate the second working member 56. The second operating member 58 includes a second operating portion 59*a*, a second driving portion 59*b* and a second extending portion 59*c* connected between the second operating portion 59*a* and the second driving portion 59*b*.

Preferably, the second working member 56 is pivotally connected to the second rail 24 through a second pivoting shaft 60.

Preferably, the second operating member 58 is movably mounted on the second rail 24. In this embodiment, the second operating member 58 can be moved with respect to the second rail 24 along a longitudinal direction of the second rail 24, and the second rail 24 can include at least one second retaining feature 61 configured to support the second operating member 58 for enhancing moving stability of the second operating member 58 when the second operating member 58 is operated to move. Furthermore, in this embodiment, the second operating member 58 also can be supported by at least one of the first wall 40*a* and the second wall 40*b* of the second rail 24, e.g., by the first wall 40*a* of the second rail 24. However, the present invention is not limited to this embodiment. For example, in another embodiment, the second operating member can be pivoted with respect to the second rail without any support provided by the second retaining feature or the wall of the second rail.

Preferably, the resilient member 52 is also configured to resiliently force the second working member 56 for resiliently retaining the second working member 56 in a third state S3. In this embodiment, the resilient member 52 can further include a second resilient portion 54*b* configured to provide a second resilient force to the first working member 44. However, the present invention is not limited to this embodiment.

Figure 4:
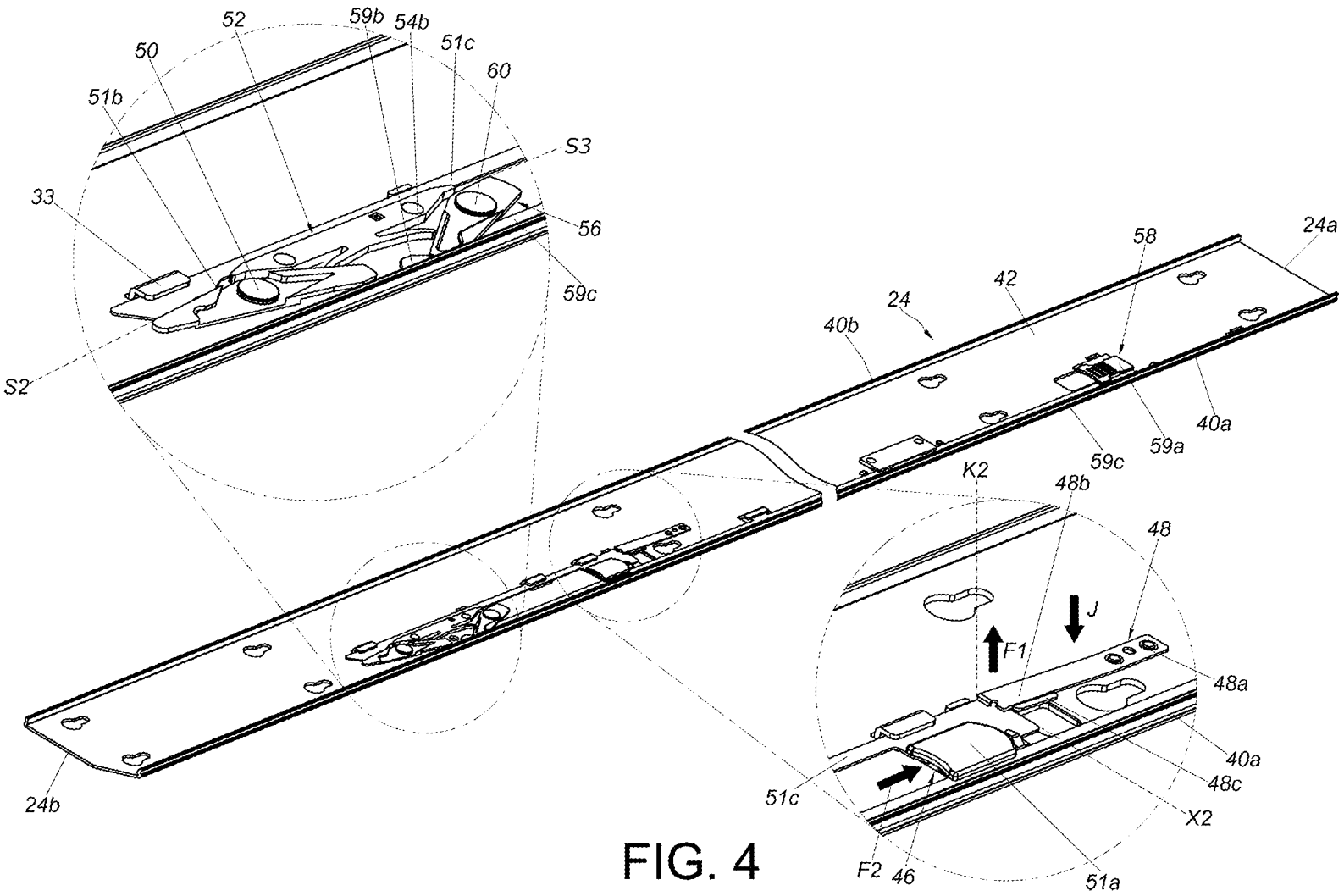
FIG. 4 is a perspective diagram of the slide rail assembly as the blocking member does not block the operating member according to the first embodiment of the present invention.

Please refer to FIG. 3 and FIG. 4. When the blocking member 48 is in a blocking state K1, the blocking member 48 blocks the first operating member 46 for restraining the first operating member 46 from driving the first working member 44 to disengage from the first state as shown in FIG. 3. When the blocking member 48 is in a non-blocking state K2 as shown in FIG. 4, e.g., when the blocking member 48 is driven by a first external force F1 provided by the user to switch from the blocking state K1 to the non-blocking state K2, the blocking member 48, e.g., the blocking segment 48*b* of the blocking member 48, is resiliently deformed to generate a recovering resilient force J opposite to the first external force F1, so that the blocking member 48 does not block the first operating member 46. When the blocking member 48 does not block the first operating member 46, the first operating member 46 is allowed to be driven by a second external force F2 as shown in FIG. 4 to move from a first position X1 as shown in FIG. 3 to a second position X2 as shown in FIG. 4 for driving the first working member 44 to switch from the first state S1 as shown in FIG. 3 to a second state S2 as shown in FIG. 4.

Specifically, when the blocking member 48 is in the blocking state K1 as shown in FIG. 3, the blocking segment 48*b* of the blocking member 48 is located in a moving path of the first operating member 46 and blocks the first operating member 46 for restraining the first operating member 46 from driving the first working member 44 to disengage from the first state S1. When it is desired to operate the first operating member 46, the user can operate the blocking segment 48*b* of the blocking member 48, e.g., apply the first external force F1 onto the operating segment 48*c* of the blocking member 48 as shown in FIG. 4, to drive the blocking segment 48*b* of the blocking member 48 to resiliently move with respect to the connecting segment 48*a* to switch the blocking member 48 from the blocking state K1 as shown in FIG. 3 to the non-blocking state K2 as shown in FIG. 4, so that the blocking segment 48*b* of the blocking member 48 and the first operating member 46 are misaligned from each other, i.e., the blocking segment 48*b* of the blocking member 48 is not located in the moving path of the first operating member 46 and cannot block the first operating member 46, for allowing the first operating member 46 to be operated, e.g., by the second external force F2 applied onto the first operating portion 51*a* of the first operating member 46, to drive the first operating member 46 to move from the first position X1 as shown in FIG. 3 to the second position X2 as shown in FIG. 4.

It should be noted that when the first operating member 46 moves from the second position as shown in FIG. 4 back to the first position as shown in FIG. 4 and the first external force F1 is removed, the blocking member 48 is driven by the recovering resilient force J to recover to the blocking state as shown in FIG. 3 from the non-blocking state as shown in FIG. 4, so that the blocking segment 48*b* of the blocking member 48 moves back in the moving path of the first operating member 46 and blocks the first operating member 46.

From the above, understandably, the user has to switch the blocking member 48 to the non-blocking state, e.g., move the blocking segment 48*b* of the blocking member 48 out of the moving path of the first operating member 46 for not blocking the first operating member 46, so that the first operating member 46 is not restrained by the blocking member 48 and operable to drive the first working member 44.

Figure 5:
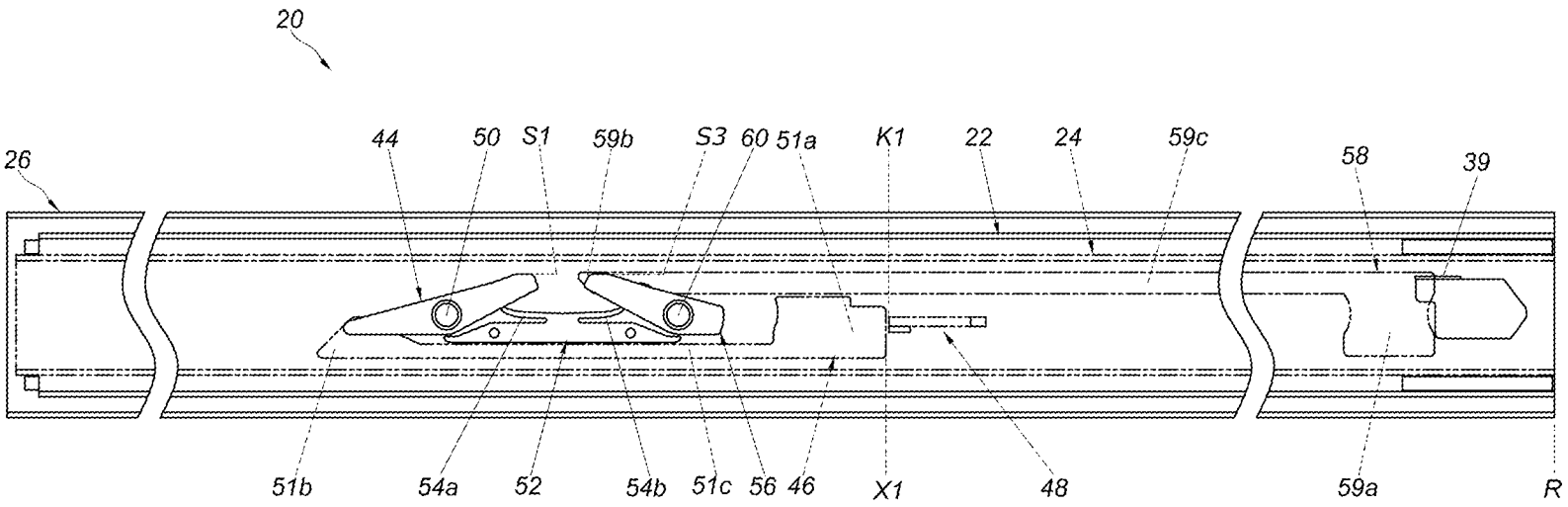
FIG. 5 is a diagram of the slide rail assembly in a retracted state according to the first embodiment of the present invention.

Please refer to FIG. 5. When the slide rail assembly 20 is in a retracted state as shown in FIG. 5, the first rail 22 and the second rail 24 are respectively retracted with respect to the third rail 26 and the first rail 22. At this moment, the second rail 24 can be located at a retracted position with respect to the first rail 22, and the first working member 44 and the second working member 56 can respectively be resiliently retained in the first state S1 and the third state S3 in response to the first resilient force and the second resilient force provided by the first resilient portion 54*a* and the second resilient portion 54*b* of the resilient member 52. Besides, the first operating member 46 can be located at the first position X1, and the blocking member 48 can be in the blocking state K1 which is the same as FIG. 3.

Figure 6:
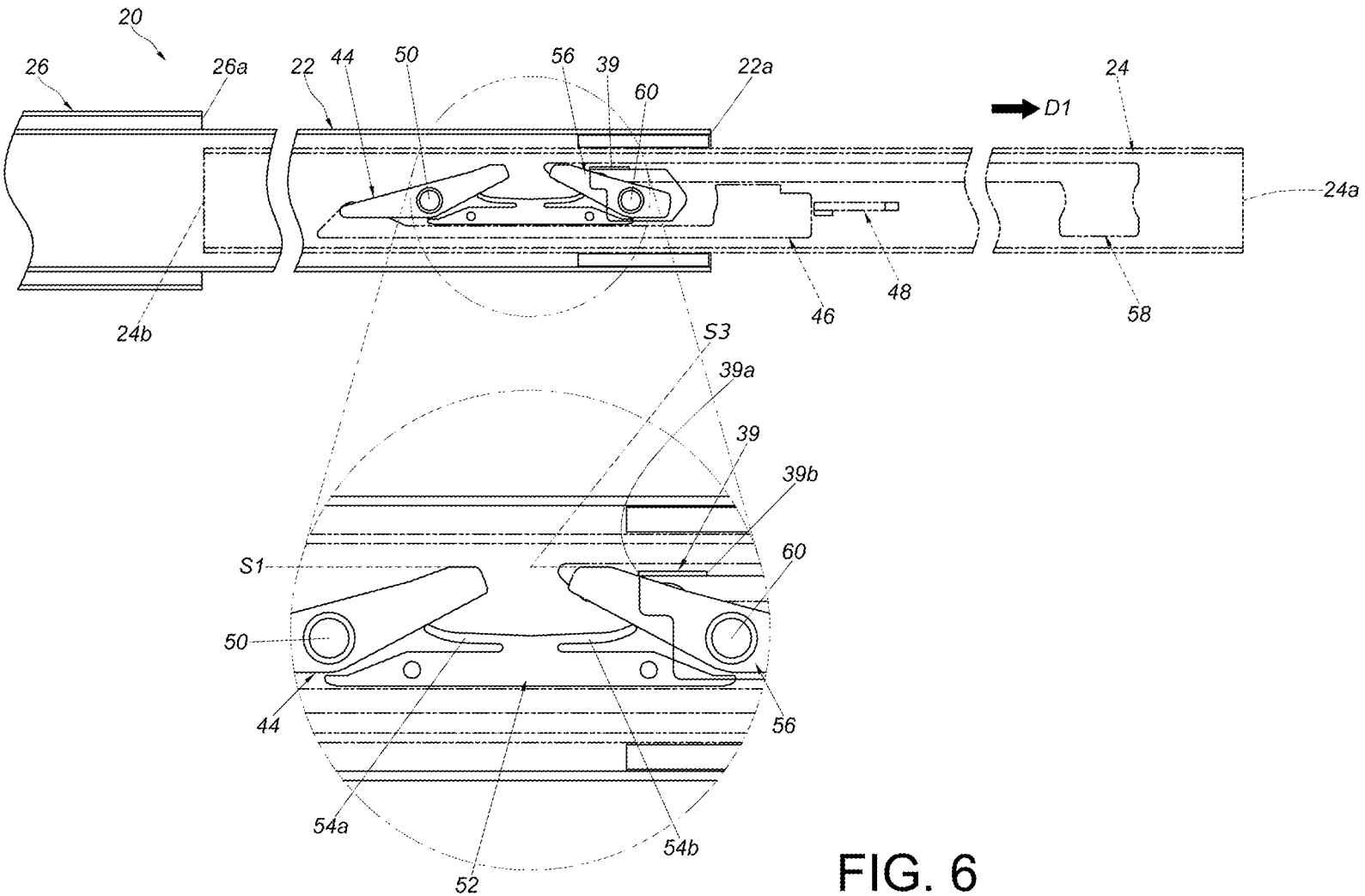
FIG. 6 to FIG. 8 are diagrams of the slide rail assembly as a second rail is located at different positions with respect to a first rail at an extended position with respect to a third rail according to the first embodiment of the present invention.

Please refer to FIG. 6. When the slide rail assembly 20 is in a state as shown in FIG. 6, the first rail 22 is extended with respect to the third rail 26, i.e., the front portion 22 of the first rail 22 protrudes from the front portion 26*a* of the third rail 26, and the second rail 24 is movable with respect to the first rail 22 toward a first predetermined direction D1, which also can be named as a predetermined direction. In this embodiment, the first predetermined direction D1 can be an opening direction. However, the present invention is not limited to this embodiment. Furthermore, when the second rail 24 is located at a position as shown in FIG. 6 with respect to the first rail 22, the second working member 56 in the third state S3 is in contact with a first end portion 39*a* of the blocking feature 39 on the first rail 22.

Figure 7:
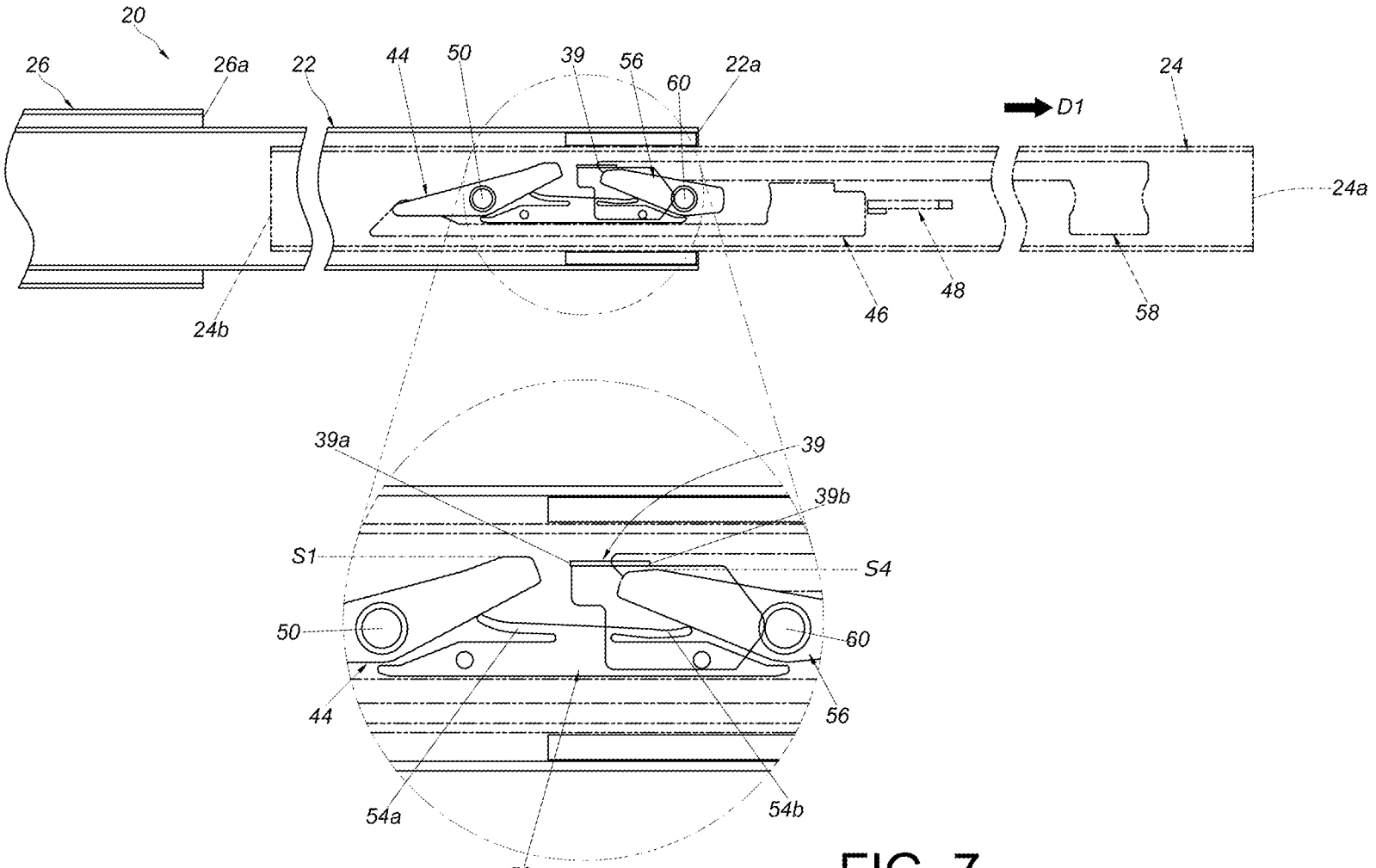

Please further refer to FIG. 7. When the second rail 24 continues to move with respect to the first rail 22 toward the first predetermined direction D1 from the position as shown in FIG. 6 to a position as shown in FIG. 7, the blocking feature 39 can force the second working member 56 to drive the second working member 56 to pivot by a predetermined angle, e.g., to switch to a fourth state S4, for allowing the second working member 56 to pass over the first end portion 39*a* of the blocking member 39. Furthermore, at this moment, the second resilient portion 54*b* of the resilient member 52 is resiliently deformed to generate the second resilient force.

Figure 8:
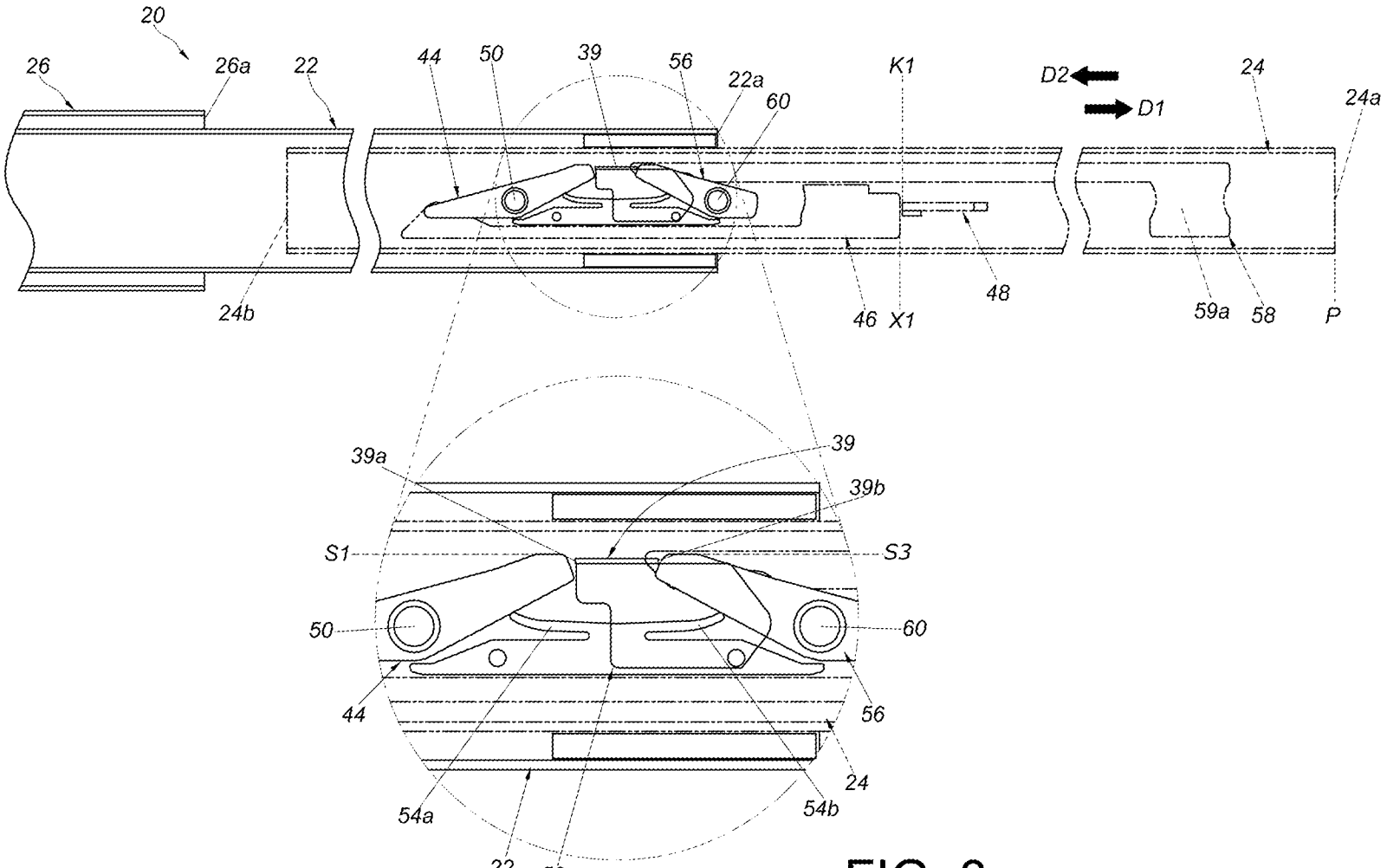

Please refer to FIG. 8. When the second rail 24 further continues to move with respect to the first rail 22 toward the first predetermined position D1 to a predetermined position P as shown in FIG. 8, e.g., an extended position, it increases a protruding length of the front portion 24*a* of the second rail 24 from the front portion 22*a* of the first rail 22, so that the slide rail assembly 20 is in an extended state, e.g., fully extended state. At this moment, the second working member 56 is not forced by the blocking feature 39 and is driven to switch back to the third state S3 in response to the second resilient force provided by the second resilient portion 54*b* of the resilient member 52. Furthermore, when the second rail 24 is located at the predetermined position P with respect to the first rail 22, the second working member 56 in the third state and the first working member 44 in the first state S1 are located adjacent to the second end portion 39*b* and the first end portion 39*a* of the blocking feature 39.

From the above, understandably, when the second rail 24 is located at the predetermined position P with respect to the first rail 22 and the first working member 44 and the second working member 56 are respectively in the first state S1 and the third state S3, the first working member 44 and the second working member 56 can respectively block the first end portion 39*a* and the second end portion 39*b* of the blocking feature 39. Since the first working member 44 and the first end portion 39*a* of the blocking feature 39 block each other, the second rail 24 is restrained from moving from the predetermined position P toward the first predetermined direction. Furthermore, since the second working member 56 and the second end portion 39*b* of the blocking feature 39 block each other, the second rail 24 is restrained from moving from the predetermined position P toward a second predetermined direction D2. In this embodiment, the second predetermined direction D2 can be a retracting direction opposite to the first predetermined direction D1. However, the present invention is not limited to this embodiment.

It should be noted that as shown in FIG. 8, when the second rail 24 is located at the predetermined position P with respect to the first rail 22 and the blocking member 48 is in the blocking state K1, which is the same as FIG. 3, the blocking member 48 blocks the first operating member 46 for restraining the first operating member 46 from driving the first working member 44 to disengage from the first state.

Figure 9:
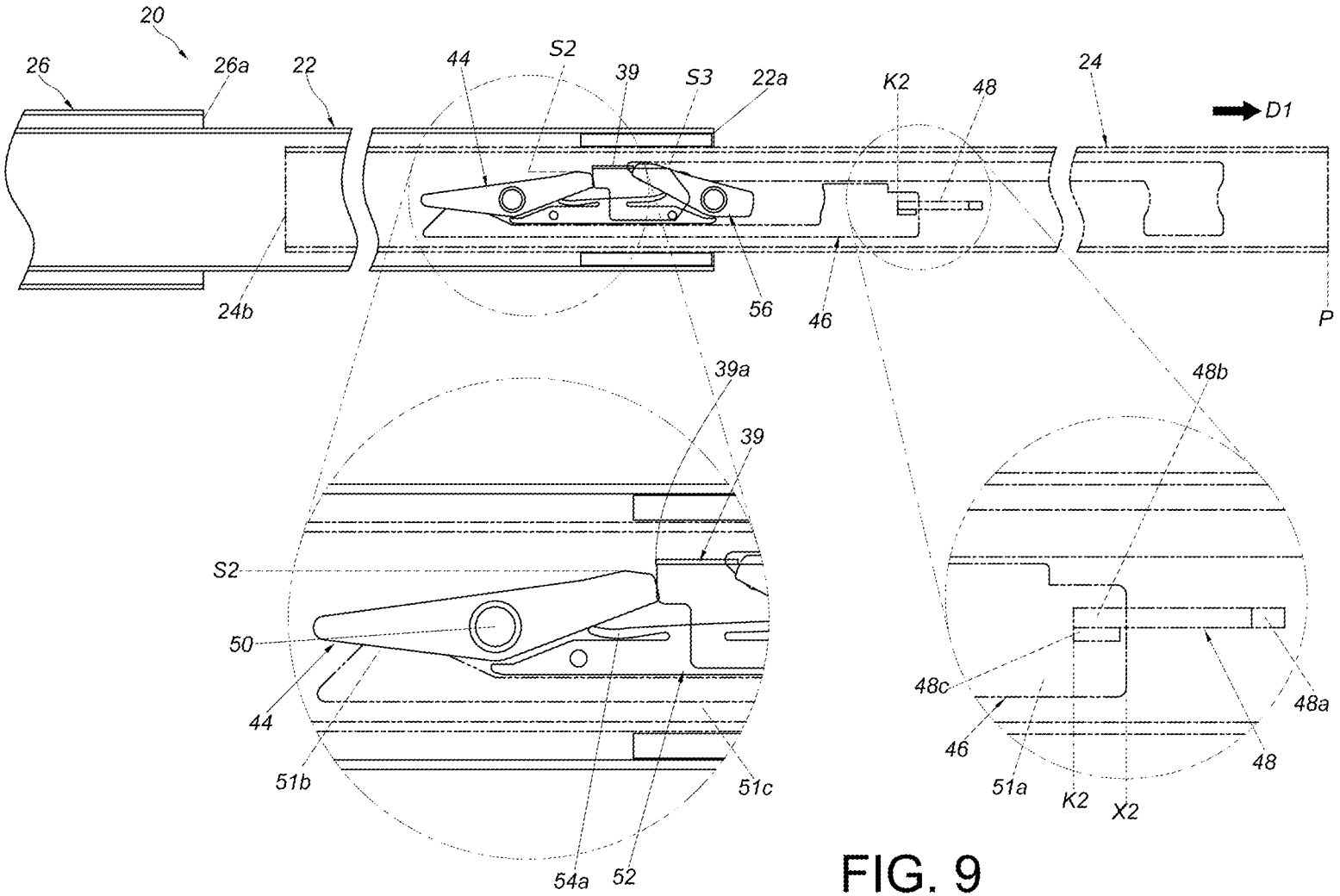
FIG. 9 is a diagram of the slide rail assembly as the second rail is allowed to move toward the first predestined direction from a predetermined position with respect to the first rail at the extended position according to the first embodiment of the present invention.

Please refer to FIG. 9. As shown in FIG. 9, when the second rail 24 is located at the predetermined position P with respect to the first rail 22 and the blocking member 48 is in the non-blocking state, which is the same as FIG. 4, the blocking segment 48*b* of the blocking member 48 and the first operating member 46 are misaligned from each other, so that the blocking member 48 does not block the first operating member 46 to allow the first operating member 46 to be driven by the second external force F2 to move from the first position X1 as shown in FIG. 8 to the second position X2 as shown in FIG. 9 for driving the first working member 44 to switch from the first state S1 as shown in FIG. 8 to the second state S2 as shown in FIG. 9. When the first working member 44 is in the second state S2, the first working member 44 and the first end portion 39*a* of the blocking feature 39 do not block each other, so that the second rail 24 is allowed to be detached from the channel 38 of the first rail 22 by moving the second rail 24 toward the first predetermined direction D1 from the predetermined position P.

Figure 10:
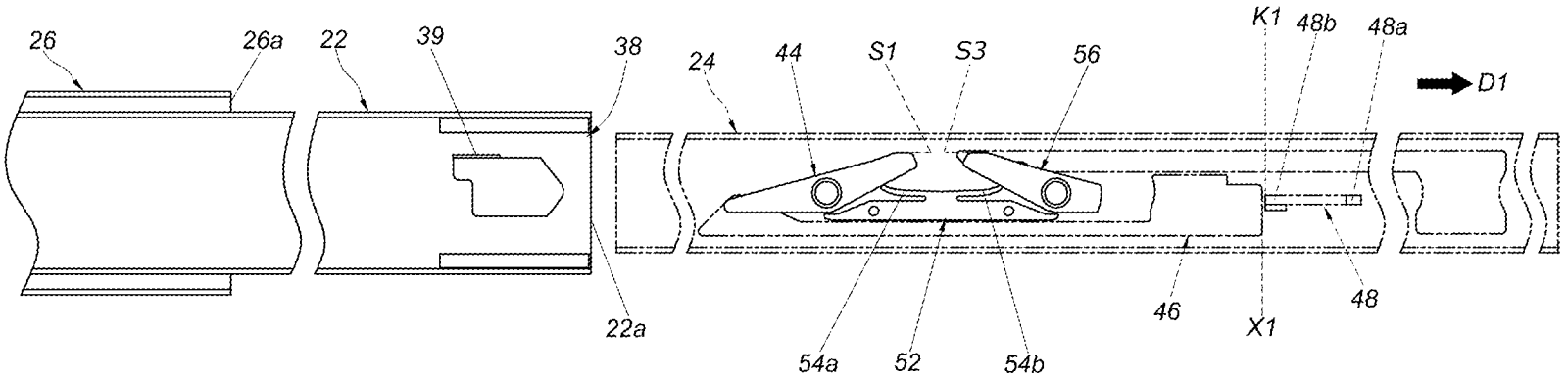
FIG. 10 is a diagram of the slide rail assembly as the second rail is detached from the first rail at the extended position according to the first embodiment of the present invention.

Please refer to FIG. 10. As shown in FIG. 10, when the second rail 24 is detached from the channel 38 of the first rail 22, the first operating member 46 can be moved back to the first position X1, so that the blocking member 48 can recover to the non-blocking state from the blocking state to move the blocking segment 48*b* of the blocking member 48 in the moving path of the first operating member 46 for blocking the first operating member 46. Furthermore, at this moment, the first working member 44 is driven by the first resilient force provided by the first resilient portion 54*a* of the resilient member 52 to switch from the second state S2 to the first state S1.

Figure 11:
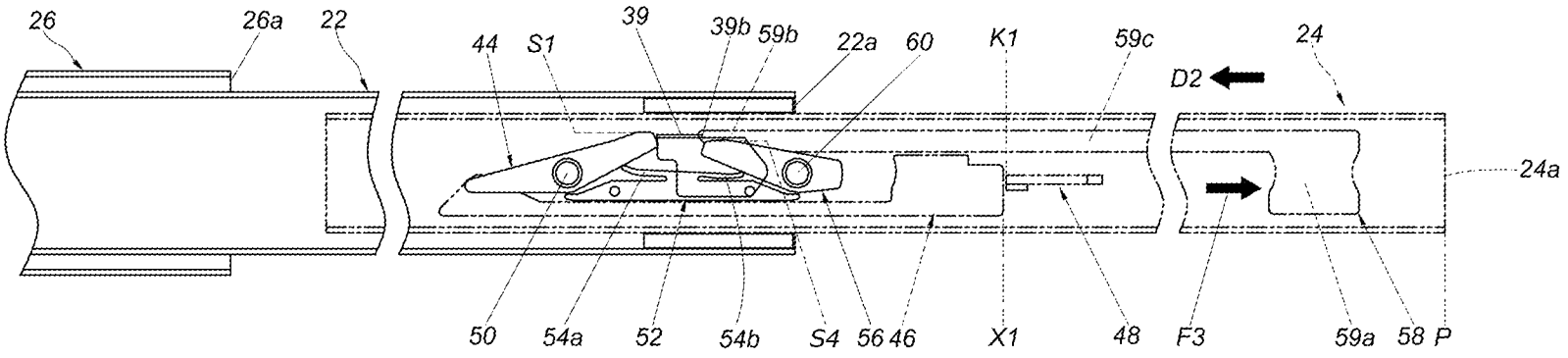
FIG. 11 is a diagram of the slide rail assembly as the second rail is allowed to move toward a second predetermined direction from the predetermined position with respect to the first rail at the extended position according to the first embodiment of the present invention.

Please refer to FIG. 8 and FIG. 11. As shown in FIG. 8 and FIG. 11, when the second rail 24 is located at the predetermined position P with respect to the first rail 22, the second operating member 58 is operable to drive the second working member 56 to switch from the third state S3 as shown in FIG. 8 to the fourth state S4 as shown in FIG. 11, so that the second working member 56 and the second end portion 39*b* of the blocking feature 39 do not block each other for allowing the second rail 24 to move toward the second predetermined direction D2 from the predetermined position P.

Specifically, when the second rail 24 is located at the predetermined position P with respect to the first rail 22, the user can operate the second operating member 58, e.g., apply a third external force F3 onto the second operating portion 59*a* of the second operating member 58, to move the second operating member 58 with respect to the second rail 24 for driving the second working member 56 to switch from the third state S3 as shown in FIG. 8 to the fourth state S4 as shown in FIG. 11. When the second working member 56 is in the fourth state S4, the second working member 56 and the second end portion 39*b* of the blocking feature 39 do not block each other for allowing the second rail 24 to move toward the second predetermined direction D2 from the predetermined position P.

Figure 12:
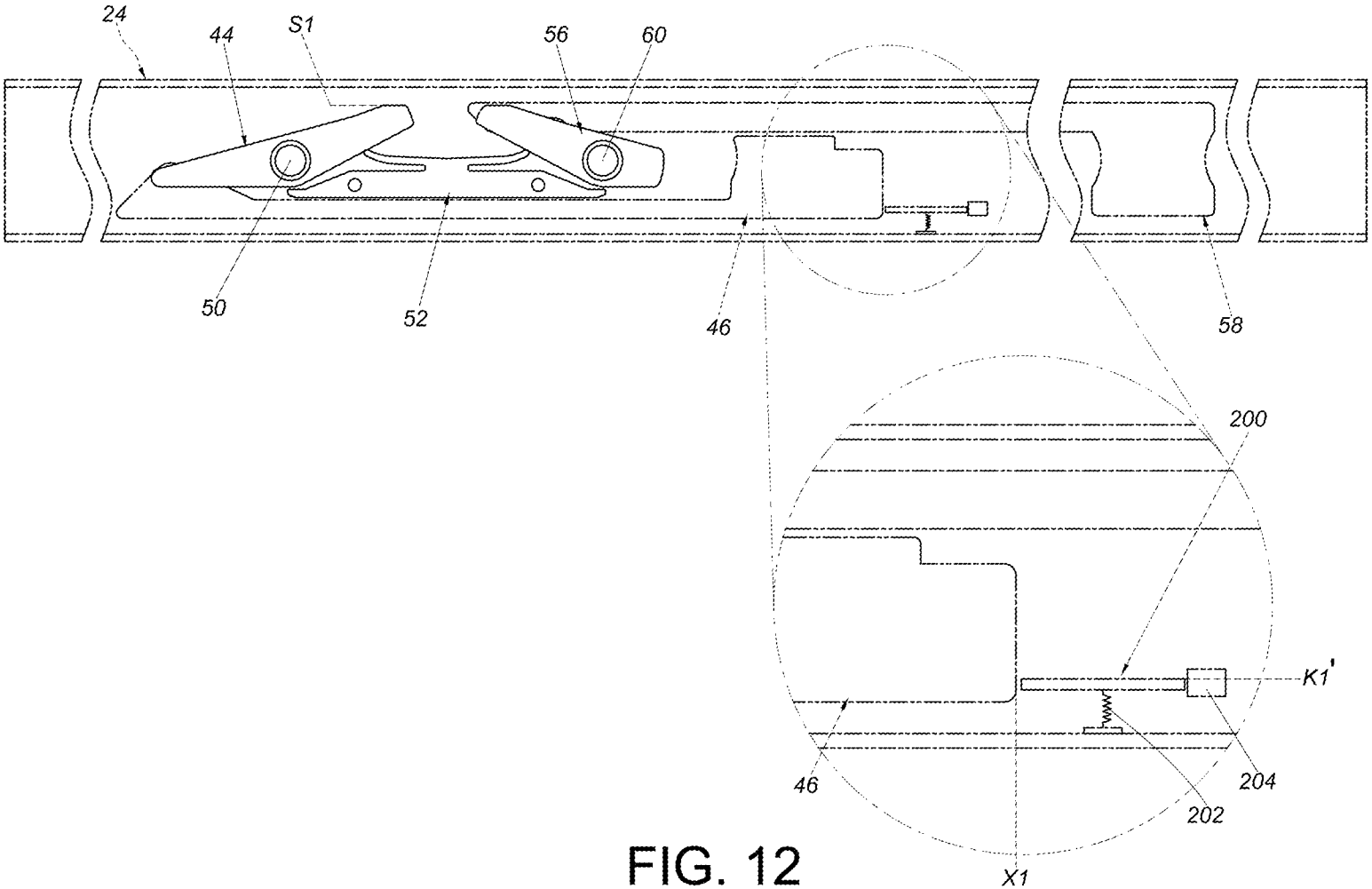
FIG. 12 is a diagram of a slide rail assembly as a blocking member blocks an operating member according to a second embodiment of the present invention.
Figure 13:
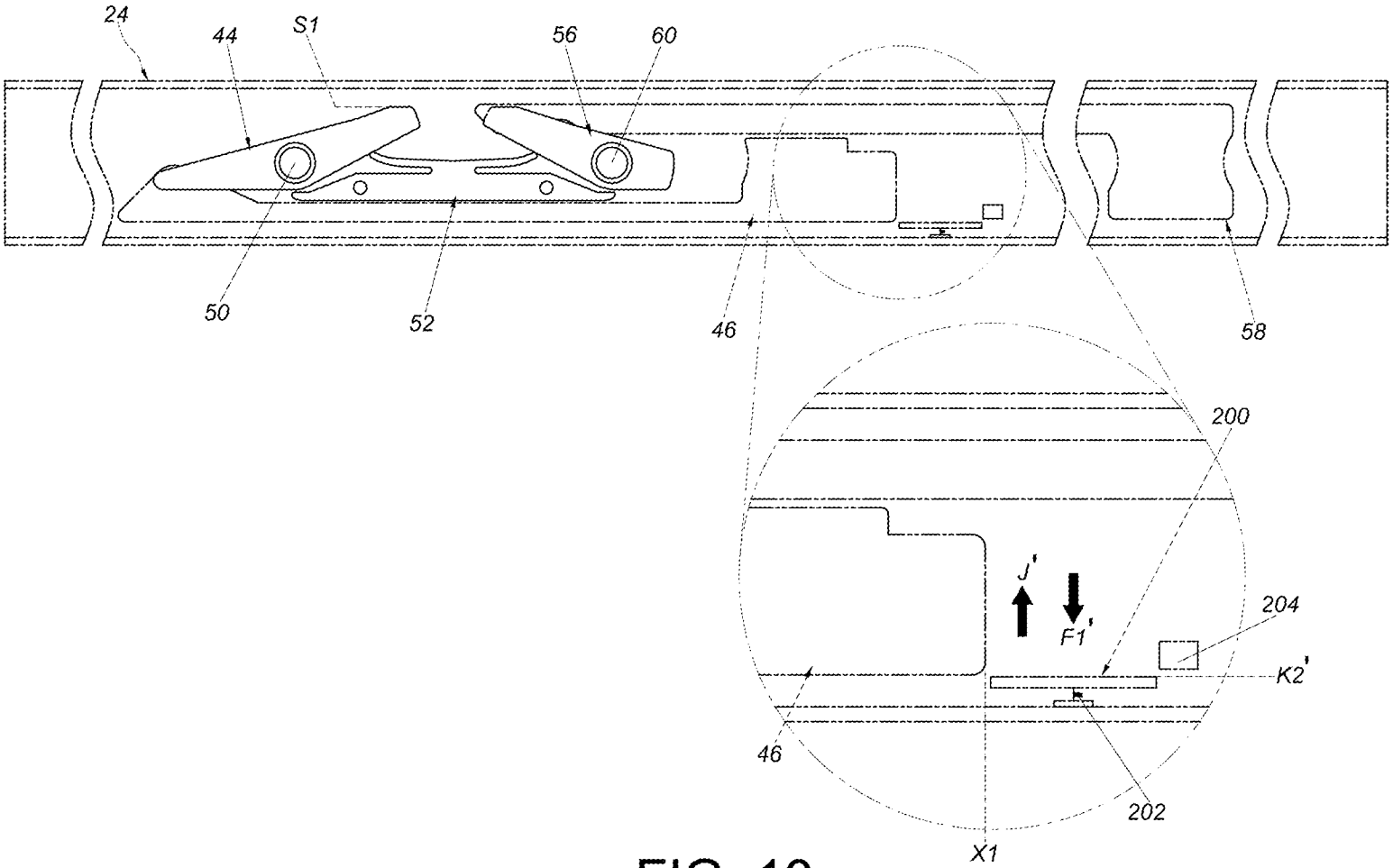
FIG. 13 is a diagram of the slide rail assembly as the blocking member does not block the operating member according to the second embodiment of the present invention.

Please refer to FIG. 12 and FIG. 13. As shown in FIG. 12 and FIG. 13, in a second embodiment of the present invention, a blocking member 200 can be loaded by an auxiliary resilient member 202, such as a spring, so that the blocking member 200 is recoverable by the auxiliary resilient member 202.

Specifically, when the blocking member 200 is in a blocking state K1' as shown in FIG. 12, the blocking member 200 blocks the first operating member 46 for restraining the first operating member 46 from driving the first working member 44 to disengage from the first state S1. Preferably, the second rail 24 includes a predetermined wall 204. In this embodiment, the predetermined wall 204 can be a protruding object. However, the present invention is not limited to this embodiment. The predetermined wall 204 can facilitate the blocking member 200 to block the first operating member 46 and enhance blocking strength of the blocking member 200 against the first operating member 46.

When the blocking member 200 is forced by a first external force F1' provided by the user to switch to a non-blocking state K2' as shown in FIG. 13, the blocking member 200 and the first operating member 46 are misaligned from each other, so that the blocking member 200 does not block the first operating member 46 for allowing the first operating member 46 to disengage from the first position X1, e.g., move from the first position X1 to the second position X2, so as to drive the first working member 44 to switch from the first state S1 to the second state S2.

It should be noted that when the blocking member 200 is in the non-blocking state K2' as shown in FIG. 13, the auxiliary resilient member 202 is resiliently deformed to generate a recovering resilient force J'. When the first external force F1' is removed, the blocking member 200 can be driven by the recovering resilient force J' provided by the auxiliary resilient member 202 to switch from the non-blocking state K2' as shown in FIG. 13 to the blocking state K1' as shown in FIG. 12 to block the first operating member 46.

From the above, understandably, the present invention includes the following feature:

1. The user has to switch the blocking members 48, 200, to the non-blocking state, so that the blocking members 48, 200 and the first operating member 46 do not block each other for allowing the first operating member 46 to be operated to drive the first working member 44. The advantage of the aforementioned configuration is to prevent the second rail 24 and/or an object carried by the second rail 24 from being detached from the first rail 22 unintentionally due to accidentally touch of the first operating member 46 when the second rail 24 is located at the predetermined position P with respect to the first rail 22.

2. The blocking members 48, 200 are recoverable. When the first external forces F1, F1' are removed, the blocking members 48, 200 can switch from the non-blocking states K2, K2' from the blocking states K1, K1' to ensure the blocking members 48, 200 to block the first operating members 46, so that the present invention has enhanced using safety.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly comprising:

a first rail comprising a blocking feature;

a second rail movable with respect to the first rail;

a first working member arranged on the second rail;

a first operating member configured to operate the first working member;

a blocking member arranged on the second rail and being resiliently recoverable;

a second working member arranged on the second rail; and a second operating member configured to operate the second working member;

wherein when the second rail is located at an extended position with respect to the first rail and the first working member is in a first state, the first working member and the blocking feature block each other for restraining the second rail from moving toward a first predetermined direction from the extended position;

wherein when the blocking member is in a blocking state, the blocking member blocks the first operating member for restraining the first operating member from driving the first working member to disengage from the first state;

wherein when the blocking member is forced to switch from the blocking state to a non-blocking state, the blocking member does not block the first operating member for allowing the first operating member to drive the first working member from the first state to a second state, when the first working member is in the second state, the first working member and the blocking feature do not block each other for allowing the second rail to move toward the first predetermined position from the extended position;

wherein when the blocking member in the non-blocking state is released, the blocking member resiliently recovers to switch from the non-blocking state to the blocking state;

wherein when the second rail is located at the extended position with respect to the first rail and the second working member is in a third state, the second working member and the blocking feature block each other for restraining the second rail from moving toward a second predetermined direction from the extended position.

2. The slide rail assembly of claim 1, wherein the first predetermined direction is an opening direction.

3. The slide rail assembly of claim 1, wherein the first rail comprises a first wall, a second wall and a longitudinal wall, the longitudinal wall of the first rail is connected between the first wall and the second wall of the first rail, the first wall, the second wall and the longitudinal wall of the first rail cooperatively define a channel for accommodating the second rail, when the blocking member is in the non-blocking state, the blocking member does not block the first operating member for allowing the first operating member to drive the first working member from the first state to the second state, when the first working member is in the second state, the first working member and the blocking feature do not block each other for allowing the second rail to be detached from the channel by moving the second rail toward the first predetermined direction from the extended position.

4. The slide rail assembly of claim 1, wherein the first operating member is movably mounted on the second rail.

5. The slide rail assembly of claim 1, wherein the first working member is pivotally connected to the second rail.

6. The slide rail assembly of claim 5, further comprising a resilient member configured to provide a resilient force to the first working member for resiliently retaining the first working member in the first state.

7. The slide rail assembly of claim 1, wherein the first rail comprises a front portion and a rear portion, and the blocking feature is located adjacent to the front portion of the first rail.

8. The slide rail assembly of claim 1, wherein when the second operating member drives the second working member from the third state to a fourth state, the second working member and the blocking feature do not block each other for allowing the second rail to move toward the second predetermined direction from the extended position.

9. The slide rail assembly of claim 8, wherein the second predetermined direction is a retracting direction.

* * * * *